US005936604A

United States Patent [19]

Endou

[11] Patent Number: 5,936,604

[45] **Date of Patent: *Aug. 10, 1999**

[54] COLOR LIQUID CRYSTAL DISPLAY APPARATUS AND METHOD FOR DRIVING THE SAME

[75] Inventor: Kenzou Endou, Hachioji, Japan

[73] Assignee: Casio Computer Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/909,373

[22] Filed: Aug. 11, 1997

Related U.S. Application Data

[63] Continuation of application No. 08/422,982, Apr. 17, 1995, abandoned.

[30] Foreign Application Priority Data

Apr. 21, 1994 [JP] Japan ..... 6-105009
Apr. 21, 1994 [JP] Japan ..... 6-105047

[51] Int. Cl.[6] ..... G09G 3/36

[52] U.S. Cl. ..... 345/101; 345/88; 345/87

[58] Field of Search ..... 345/84, 87, 88, 345/98, 101, 154

[56] References Cited

U.S. PATENT DOCUMENTS

| | | | |
|---|---|---|---|
| 4,687,956 | 8/1987 | Itoh et al. | 345/101 |
| 4,761,058 | 8/1988 | Okubo et al. | 345/87 |
| 4,786,893 | 11/1988 | Moore | 345/154 |
| 4,944,578 | 7/1990 | Denison | 345/88 |
| 4,952,032 | 8/1990 | Inoue et al. | 345/101 |
| 5,066,945 | 11/1991 | Kanno et al. | 345/101 |
| 5,126,868 | 6/1992 | Kizaki et al. | 359/86 |
| 5,196,738 | 3/1993 | Takahara et al. | 345/89 |
| 5,280,280 | 1/1994 | Hotto | 345/98 |
| 5,300,942 | 4/1994 | Dolgoff | 345/84 |
| 5,444,457 | 8/1995 | Hotto | 345/94 |
| 5,489,918 | 2/1996 | Mosier | 345/101 |

*Primary Examiner*—Amare Mengistu
*Assistant Examiner*—Ricardo Osorio
*Attorney, Agent, or Firm*—Frishauf, Holtz, Goodman, Langer & Chick, P.C.

[57] ABSTRACT

An image memory for storing image data is connected to an applied voltage selecting circuit through a reading circuit. Image data is supplied to the applied voltage selecting circuit at predetermined timing. A temperature sensor for measuring a temperature of a liquid crystal display panel is connected to the applied voltage selecting circuit and supplies temperature data of the liquid crystal display panel to the applied voltage selecting circuit. The applied voltage selecting circuit is connected to a signal electrode driving circuit for applying a voltage to a signal electrode of the liquid crystal display panel, so as to supply applied voltage selecting signals S0 to S15 to the signal electrode driving circuit in accordance with the temperature data and the image data. The signal electrode driving circuit is connected to a driving voltage generating circuit, to which 16-staged voltages V0 to V15 are supplied. The signal electrode driving circuit selects a voltage corresponding to the applied voltage selecting signal and applies the selected voltage to the signal electrode.

18 Claims, 12 Drawing Sheets

| IMAGE DATA | DISPLAYED COLOR | APPLIED VOLTAGE SELECTING SIGNAL | |
|---|---|---|---|
| | | BELOW 32.5°C | 32.5°C OR HIGHER |
| 1111 | | S15 | S13 |
| 1110 | | S14 | S12 |
| 1101 | BLUE | S13 | S11 |
| 1100 | | S12 | S10 |
| 1011 | | S11 | S9 |
| 1010 | | S10 | S8 |
| 1001 | | S9 | S7 |
| 1000 | GREEN | S8 | S6 |
| 0111 | | S7 | S5 |
| 0110 | | S6 | S4 |
| 0101 | | S5 | S3 |
| 0100 | | S4 | S2 |
| 0011 | | S3 | S1 |
| 0010 | RED | S2 | S0 |
| 0001 | | S1 | |
| 0000 | | S0 | |

FIG.6

| IMAGE DATA | DISPLAYED COLOR | APPLIED VOLTAGE SELECTING SIGNAL | | | |
|---|---|---|---|---|---|
| | | BELOW 20°C | 20°C ≦ <30°C | 30°C ≦ <40°C | 40°C OR HIGHER |
| 1 1 1 1 | | | S15 | S14 | S13 |
| 1 1 1 0 | | S15 | S14 | S13 | S12 |
| 1 1 0 1 | BLUE | S14 | S13 | S12 | S11 |
| 1 1 0 0 | | S13 | S12 | S11 | S10 |
| 1 0 1 1 | | S12 | S11 | S10 | S9 |
| 1 0 1 0 | | S11 | S10 | S9 | S8 |
| 1 0 0 1 | | S10 | S9 | S8 | S7 |
| 1 0 0 0 | GREEN | S9 | S8 | S7 | S6 |
| 0 1 1 1 | | S8 | S7 | S6 | S5 |
| 0 1 1 0 | | S7 | S6 | S5 | S4 |
| 0 1 0 1 | | S6 | S5 | S4 | S3 |
| 0 1 0 0 | | S5 | S4 | S3 | S2 |
| 0 0 1 1 | | S4 | S3 | S2 | S1 |
| 0 0 1 0 | RED | S3 | S2 | S1 | S0 |
| 0 0 0 1 | | S2 | S1 | S0 | |
| 0 0 0 0 | | S1 | S0 | | |

FIG. 7

| IMAGE DATA | DISPLAYED COLOR | APPLIED VOLTAGE SELECTING SIGNAL | | |
|---|---|---|---|---|
| | | AT LEAST 3.5% LOWERED | REFERENCE VOLTAGE | AT LEAST 3.5% HIGHERED |
| 1 1 1 1 | | S15 | S15 | S14 |
| 1 1 1 0 | | S15 | S14 | S13 |
| 1 1 0 1 | BLUE | S14 | S13 | S12 |
| 1 1 0 0 | | S13 | S12 | S11 |
| 1 0 1 1 | | S12 | S11 | S10 |
| 1 0 1 0 | | S11 | S10 | S9 |
| 1 0 0 1 | | S10 | S9 | S8 |
| 1 0 0 0 | GREEN | S9 | S8 | S7 |
| 0 1 1 1 | | S8 | S7 | S6 |
| 0 1 1 0 | | S7 | S6 | S5 |
| 0 1 0 1 | | S6 | S5 | S4 |
| 0 1 0 0 | | S5 | S4 | S3 |
| 0 0 1 1 | | S4 | S3 | S2 |
| 0 0 1 0 | RED | S3 | S2 | S1 |
| 0 0 0 1 | | S2 | S1 | S0 |
| 0 0 0 0 | | S1 | S0 | S0 |

FIG.10

| IMAGE DATA | DISPLAYED COLOR | APPLIED VOLTAGE SELECTING SIGNAL | | |
|---|---|---|---|---|
| | | 540nm OR LONGER | 495nm~540nm | 495nm OR SHORTER |
| 1111 | | S15 | S15 | S14 |
| 1110 | | S15 | S14 | S13 |
| 1101 | BLUE | S14 | S13 | S12 |
| 1100 | | S13 | S12 | S11 |
| 1011 | | S12 | S11 | S10 |
| 1010 | | S11 | S10 | S9 |
| 1001 | | S10 | S9 | S8 |
| 1000 | GREEN | S9 | S8 | S7 |
| 0111 | | S8 | S7 | S6 |
| 0110 | | S7 | S6 | S5 |
| 0101 | | S6 | S5 | S4 |
| 0100 | | S5 | S4 | S3 |
| 0011 | | S4 | S3 | S2 |
| 0010 | RED | S3 | S2 | S1 |
| 0001 | | S2 | S1 | S0 |
| 0000 | | S1 | S0 | S0 |

FIG.13

COLOR LIQUID CRYSTAL DISPLAY APPARATUS AND METHOD FOR DRIVING THE SAME

This application is a Continuation of application Ser. No. 08/422,982, filed Apr. 17, 1995 is now abandoned.

BACKGROUND OF THE INVENTION

1. Field of the Invention

The present invention relates to a color liquid crystal display apparatus and a method for driving the same, in which a desired color image, owing to birefringence of liquid crystal, can be displayed stably without deviation of a displayed color due to a change in environment temperature or source voltage or the like.

2. Description of the Related Art

A color liquid crystal display apparatus of an ECB (electrically controlled birefringence) system is conventionally known. In the ECB system, an electric field is applied to liquid crystal, thereby changing the arrangement of molecules of liquid crystal, and a color image is displayed utilizing the change in birefringence of the liquid crystal due to the change of the molecular arrangement. This type of color liquid crystal display apparatus is suitable for a portable device, since it does not require a back light and consumes less power. However, it is disadvantageous in that so-called color deviation easily occurs, i.e., a displayed color is likely to change depending on a change in environment temperature and/or source voltage.

FIG. 1 is a graph showing the relationship between an applied voltage and a displayed color at different temperatures in a color liquid crystal display apparatus of the EBC system. In FIG. 1, the abscissa represents the applied voltage and the ordinate represents the change in color. The solid line represents the change in color at 25° C., the dot line represents the change in color at 40° C. and the one-dot-chain line represents the same at 0° C.

As shown in the graph, in the conventional color liquid crystal display, the displayed color changes in accordance with the environment temperature, i.e., the temperature of a liquid crystal display, even when the same voltage is applied. Therefore, a stable color image cannot be displayed. In addition, the displayed color is varied in different voltages (VG, VG').

Further, when a circuit for generating a voltage to be applied to electrodes of a liquid crystal element is of a type in which a source voltage supplied from a power source (e.g., a battery) is divided or boosted before it is applied to the electrodes, the voltage applied to the electrodes is varied in accordance with change in the source voltage due to, for example, consumption of the battery. For this reason, an effective voltage applied to the liquid crystal is varied, with the result that the color corresponding to image data cannot be displayed, that is, the color deviation occurs.

SUMMARY OF THE INVENTION

Accordingly, an object of the present invention is to provide a color liquid crystal display apparatus for displaying a color image utilizing birefringence of liquid crystal, without using a color filter, so that change in a displayed color due to change in the environment temperature and/or the source voltage is prevented and a desired color display can be stably obtained.

To achieve the above object, the color liquid crystal display apparatus of the present invention comprises: a liquid crystal display element, including liquid crystal, for displaying a plurality of display colors in accordance with a voltage applied to each of pixels comprising a display image, in which a birefringence action of the liquid crystal is controlled by applying a voltage to the liquid crystal; image data supplying means for supplying image data defining a display color to be displayed in the respective pixels; and drive control means for applying to the liquid crystal, upon reception of the image data, an effective voltage for controlling the birefringence action of the liquid crystal to display the display color defined by the image data supplied from the image data supplying means, so as to compensate a difference between the display color defined by the image data and a color displayed in the liquid crystal display element.

With the aforementioned color liquid crystal display apparatus, an input light is converted to a linearly polarized light, while being transmitted through a polarizing plate on the input side. The linearly polarized light is converted to an elliptically polarized light consisting of light components having different wavelengths, while being transmitted through a liquid crystal layer, molecules of which are aligned in a twisted manner. Of the components of the elliptically polarized light having the different wavelengths, a component (transmission axis component) having a greater amount of light along a transmission axis of a polarizing plate on an output side transmits a polarizing plate more easily. Hence, the light transmitted through the polarizing plate on the output side assumes a color of light having a wavelength of a greater ratio of the components.

A display color thus obtained can be altered by changing the voltage applied to the liquid crystal layer so as to change the arrangement of molecules of liquid crystal, since the elliptically polarized state of light of every wavelength is changed in accordance with the arrangement of molecules in the liquid crystal layer.

In order to compensate a difference (color deviation) between a display color defined by a piece of image data and a displayed color of the liquid crystal display element, a voltage applied to the signal electrode of the pixel corresponding to the image data is controlled, thereby applying an effective voltage to display the display color defined by the image data to the pixel. As a result, the display color defined by the image data can be displayed stably.

In the above color liquid crystal display apparatus, it is preferable that the drive control means comprise control means for selectively applying, to liquid crystal of a pixel corresponding to a piece of image data, at least two signal voltages determined in advance for at least one display color, or that the drive control means comprise means for selectively applying, to liquid crystal of a pixel corresponding to a piece of image data, a plurality of signal voltages determined in advance for different display colors in one-to-one correspondence or at least two signal voltages determined in advance for at least one display color. With this structure, since it is only necessary to select one of a plurality of voltages as an applied voltage, without additionally generating a voltage, the circuit of the drive control means is simple.

The drive control means may comprise detecting means for detecting a change in the display color of the liquid crystal display element and outputting a correction signal and control means which receives the correction signal output from the detecting means and image data supplied from the image data supplying means, and selectively applies at least two signal voltages determined in advance for at least one display color to a pixel of the liquid crystal display element in accordance with the correction signal, so that the display color defined by the image data is not substantially changed.

Further, the drive control means may comprise detecting means for detecting a difference between the display color defined by a piece of image data and the color displayed in the liquid crystal display element and outputting a correction signal; a voltage generating circuit for generating signal voltages of the number greater than the number of the plurality of display colors defined by the image data supplied from the image data supplying means; and control means which receives the correction signal output from the detecting means and the image data supplied from the image data supplying means and selectively applies, to a pixel of the liquid crystal display element, a signal voltage output from the voltage generating circuit, in accordance with the correction signal, so that the display color defined by the image data substantially coincides with the color displayed in the liquid crystal display element.

Furthermore, the drive control means may comprise: detecting means for detecting a temperature of the liquid crystal display element and outputting a correction signal; and control means which receives the correction signal output from the detecting means and the image data supplied from the image data supplying means and selectively applies different voltages for displaying substantially the same display color to a pixel of the liquid crystal display element in accordance with the correction signal.

In a case where the aforementioned temperature detecting means is provided in the liquid crystal display apparatus, the control means may be of a type which prepares a plurality of voltages corresponding to different temperatures of the liquid crystal display element in accordance with the display color defined by the image data, and selects one of the plurality of voltages in accordance with the correction signal and applies it to liquid crystal of the pixel. Alternatively, the control means may be of a type which comprises: storage means for storing voltages applied to the pixels of the liquid crystal display element in accordance with the display color defined by the image data in each of a plurality of temperature ranges of the liquid crystal display element; and voltage applying means for reading from the storage means a voltage corresponding to the image data and the correction signal, and applying it to the pixels. It is preferable that the control means comprise a voltage generating circuit for generating signal voltages of a number greater than a number of the plurality of display colors defined by the image data supplied from the image data supplying means; storage means for storing voltage selecting signals for selecting a signal voltage to be applied to the pixel of the liquid crystal display element in accordance with the display color defined by the image data in each of a plurality of temperature ranges of the liquid crystal display element; and voltage selecting means for reading a voltage selecting signal from the storage means based on the image data and the correction signal, selecting a signal voltage corresponding to the voltage selecting signal from the signal voltages and applying the selected signal voltage to the pixel. With the temperature detecting means as described above, a desired color display can be stable obtained by controlling the voltage applied to the liquid crystal in accordance with the correction signal output from the temperature detecting means, irrespective of a change in temperature of the liquid crystal display element.

The drive control means may comprise means for detecting a source voltage, in place of the temperature detecting means. In this case, it is preferable that the drive control means comprise control means which receives the correction signal output from the detecting means and the image data supplied from the image data supplying means and selectively applies different voltages for displaying substantially the same display color to a pixel of the liquid crystal display element in accordance with the correction signal, in addition to detecting means for detecting a source voltage for generating a voltage to be applied to the liquid crystal display element and outputting a correction signal. The control means may be of a type which prepares a plurality of voltages corresponding to different ranges of the source voltage in accordance with the display color defined by a piece of image data, selects one of the plurality of voltages in accordance with the correction signal, and applies it to liquid crystal of the pixel. Alternatively, the control means may be of a type which comprises: storage means for storing voltages applied to the pixels of the liquid crystal display element in accordance with the display color defined by the image data in each of a plurality of voltage ranges of the source voltage; and voltage applying means for reading from the storage means a voltage corresponding to the image data and the correction signal, and applying it to the pixels. Further, it is preferable that the control means comprise: a voltage generating circuit for generating signal voltages of a number greater than a number of the plurality of display colors defined by the image data supplied from the image data supplying means; storage means for storing voltage selecting signals for selecting a signal voltage applied to the pixel of the liquid crystal display element in accordance with the display color defined by the image data in each of a plurality of temperature ranges of the liquid crystal display element; and voltage selecting means for reading a voltage selecting signal from the storage means based on the image data and the correction signal, selecting a signal voltage corresponding to the voltage selecting signal from the signal voltages and applying the selected signal voltage to the pixel. With the source voltage detecting means as described above, a desired color display can be stably obtained by controlling the voltage applied to the liquid crystal in accordance with the correction signal output from the source voltage detecting means, irrespective of a change in temperature of the liquid crystal display element.

The above object can be achieved also by a color liquid crystal display apparatus comprising: a liquid crystal display element for displaying a color image including a plurality of display colors, in which a birefringence action of liquid crystal is controlled by applying a voltage to the liquid crystal; image data supplying means for supplying image data defining a display color; and drive control means, in which a plurality of voltage stages are preset with respect to a source voltage for generating a voltage to be applied to the liquid crystal display element, for shifting a voltage stage selected from the plurality of voltage stages in accordance with the image data supplied from the image data supplying means, applying a voltage corresponding to the selected voltage stage to the liquid crystal display element and obtaining an effective voltage to be given to the liquid crystal display element in order to display the defined color, so as to compensate a color difference between a displayed color and the defined color.

With the color liquid crystal display apparatus as described above, a color display is obtained by controlling the voltage applied to the liquid crystal in accordance with the image data, so that the birefringence action of the liquid crystal is altered. In the device, a plurality of voltage stages are set in advance with respect to the power source for generating a voltage to be applied to the liquid crystal display element, and a voltage, corresponding to the voltage stage selected from the plurality of voltage stages in accordance with the image data supplied from the image data supplying means, is shifted so as not to cause color deviation. Accordingly, an effective voltage for displaying the defined color is given to the liquid crystal display element, so that a desired display color is obtained stably. In addition, since it is only necessary to select one of the plurality of voltages as a voltage to be applied, without additionally generating a voltage, the circuit of the drive control means is simple.

Another object of the present invention is to provide a method for driving a color liquid crystal display apparatus for displaying a color image utilizing birefringence of liquid crystal, without using a color filter, so that change in a displayed color due to change in the temperature of the liquid crystal display element or the source voltage is prevented and a desired color display can be stably obtained.

To achieve the above object, there is provided a method for driving a color liquid crystal display apparatus comprising a liquid crystal display element, including liquid crystal for displaying a plurality of display colors in accordance with a voltage applied to each of pixels comprising a display image, wherein a birefringence action of the liquid crystal is controlled by applying a voltage to the liquid crystal, the method comprising: a step of preparing a plurality of signal voltages corresponding to each of different display colors of the liquid crystal display element; and a voltage applying step of selecting a signal voltage corresponding to a display color defined by a piece of image data and applying the selected signal voltage to liquid crystal of a pixel, to compensate a change in the display color of the pixel.

With the above method for driving a color liquid crystal display apparatus, to obtain a color display by controlling a voltage applied to the liquid crystal display element including twist nematic liquid crystal, so as to change the birefringence action of the twist nematic liquid crystal, a plurality of signal voltages corresponding to at least different display colors of the liquid crystal display element are prepared; and a signal voltage corresponding to a display color defined by a piece of image data is selected and applied to the selected signal voltage to liquid crystal of a pixel, so as to compensate a change in the display color of the pixel. In this manner, a desired color display can be stably obtained only by selecting an applied voltage.

In the above method for driving a color liquid crystal display apparatus, it is preferable that the step of preparing a plurality of signal voltages include a sub-step of preparing at least two signal voltages, set in advance for at least one display color, with respect to liquid crystal of the pixel corresponding to the piece of image data; and the voltage applying step include a sub-step of selectively applying the two signal voltages to the liquid crystal of the pixel.

Further, it is preferable that the step of preparing a plurality of signal voltages include a sub-step of preparing at least two signal voltages, set in advance for at least one display color, with respect to liquid crystal of the pixel corresponding to the piece of image data; and the voltage applying step include a sub-step of detecting a change in the display color of the liquid crystal display element and outputting a correction signal and a sub-step of selectively applying the at least two signal voltages to the liquid crystal of the pixel in response to the correction signal, so that the display color defined by the image data is not substantially changed.

Furthermore, it is preferable that the step of preparing a plurality of signal voltages include a sub-step of generating signal voltages of a number greater than a number of the plurality of display colors defined by the image data supplied from image data supplying means; and the voltage applying step include a sub-step of detecting a temperature of the liquid crystal display element and outputting a correction signal, a sub-step of reading a signal voltage to be applied to the pixel of the liquid crystal display element, based on the image data and the correction signal, in accordance with the display color defined by the image data, from storage means for storing signal voltages in each of a plurality of temperature ranges of the liquid crystal display element, and a sub-step of applying the read signal voltage to liquid crystal of the pixel. With this method, even if the temperature of the liquid crystal display element is changed, a desired color can be obtained stably.

In addition, it is preferable that the step of preparing a plurality of signal voltages include a sub-step of receiving a source voltage and generating signal voltages of the number greater than the number of the plurality of display colors defined by the image data supplied from image data supplying means; and the voltage applying step includes a sub-step of detecting a voltage of a power source and outputting a correction signal, a sub-step of reading a signal voltage to be applied to the pixel of the liquid crystal display element, based on the image data and the correction signal, in accordance with the display color defined by the image data from storage means for storing signal voltages in each of a plurality of voltage ranges of the power source, and a sub-step of applying the read signal voltage to liquid crystal of the pixel. With this method, even if the source voltage for generating a signal voltage is changed, a desired color can be obtained stably.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 6 is a diagram showing an example of the table stored in the applied voltage selecting circuit shown in FIG. 5;

FIG. 7 is a diagram showing a modification of the table shown in FIG. 6;

FIG. 10 is a diagram showing an example of the table stored in the applied voltage selecting circuit shown in FIG. 9;

FIG. 13 is a diagram showing an example of the table stored in the applied voltage selecting circuit shown in FIG. 12.

DETAILED DESCRIPTION OF THE PREFERRED EMBODIMENTS

Figure 1:
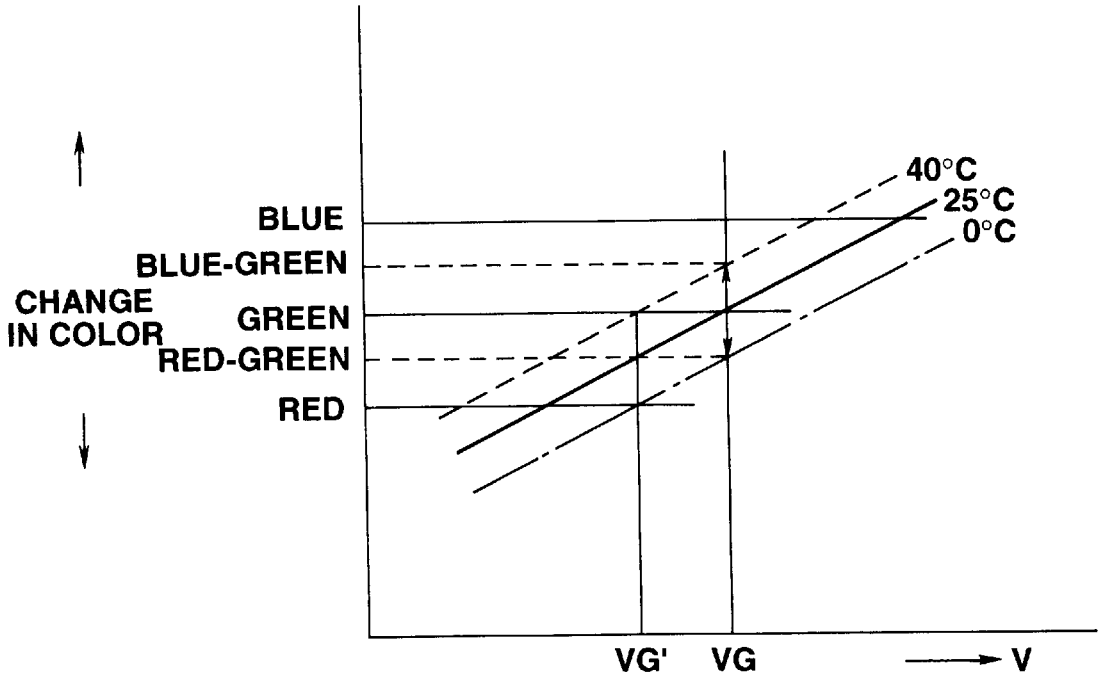
FIG.1 (PRIOR ART)
FIG. 1 is a graph showing the relationship between an applied voltage and a displayed color at different temperatures in a conventional color liquid crystal display apparatus.

Embodiments of the present invention will be described with reference to FIGS. 2 to 13.

First Embodiment

The structure of a liquid crystal display panel (liquid crystal display element) used in a first embodiment will be described with reference to FIGS. 2 and 3.

In this embodiment, a liquid crystal cell of a so-called STN (super twisted nematic) type liquid crystal, having a large twist-alignment angle of 180° to 270°, is employed. The liquid crystal is driven by a simple matrix driving method, in which display signals are supplied to respective signal electrodes, while a plurality of scan electrodes are being successively scanned, thereby displaying a color image.

In the following description, the terms "upper" and "lower" respectively mean upper and lower sides in the drawings, not upper and lower sides in the gravitational direction.

A concrete structure of the liquid crystal display element will now be described.

Figure 2:
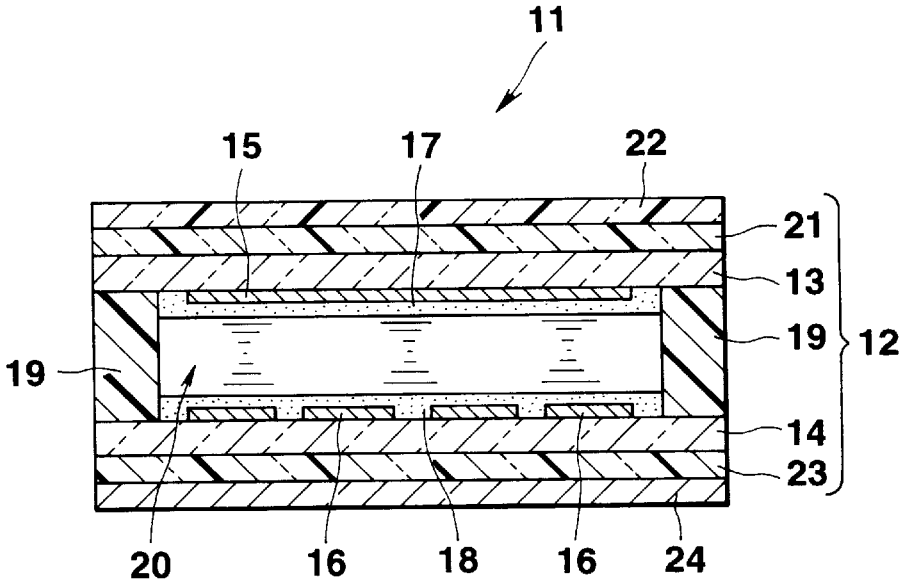
FIG. 2 is a cross sectional view of a liquid crystal display element of a color liquid crystal display apparatus according to a first embodiment of the present invention.

FIG. 2 is a cross sectional view showing the structure of a liquid crystal display panel 11 according to this embodiment.

In FIG. 2, a liquid crystal cell 12 is a so-called STN (super twisted nematic) type cell, in which liquid crystal molecules are twist-aligned at a large angle of 180° to 270°. The liquid crystal cell 12 comprises an upper glass substrate 13 and a lower glass substrate 14 opposed to each other with a minute gap (several $\mu$m) interposed therebetween, in which a liquid crystal layer 20 is inserted. A plurality of scan electrodes 15 and a plurality of signal electrodes 16, made of a transparent conductive material such as ITO (an oxide of indium and tin), are arranged respectively on the opposed surfaces of the glass substrates 13 and 14. The scan electrodes 15 and the signal electrodes 16 cross each other in separate levels.

Aligning films 17 and 18 are formed on the opposed surfaces of the glass substrates 13 and 14 of the liquid crystal cell 12, over the scan electrodes 15 and the signal electrodes 16, in order to restrict the aligning directions of liquid crystal molecules. The aligning films 17 and 18 are subjected to an aligning process, such as the rubbing method in which the surfaces of the films are rubbed by cloth, so that the longitudinal direction of liquid crystal molecules, adjacent to the surfaces, coincides with the aligning process direction.

A sealing member 19 is provided between the peripheral portions of the glass substrates 13 and 14 to maintain the predetermined gap between the glass substrates 13 and 14 and to seal liquid crystal in a region surrounded by the sealing member.

In the liquid crystal layer 20, liquid crystal molecules are arranged so as to be twist-aligned at a twist-alignment angle of 180° to 270° from one substrate toward the other.

A retardation plate 21 is to polarize a linearly polarized light, transmitted through an upper polarizing plate 22, to an elliptically polarized light. The plate 21 is arranged so that its optical axis (phase advance axis or phase delay axis) makes a predetermined angle with a transmission axis of the upper polarizing plate 22 adjacent to the retardation plate 21.

The upper polarizing plate 22 and a lower polarizing plate 23 cut off (absorb) a polarized component of incident light in a direction along an absorption axis and transmit a polarized component in a direction perpendicular thereto.

A reflecting plate 24 is provided on the lower surface of the lower polarizing plate 23 in order to reflect light, which has been incident on the upper polarizing plate 22 and transmitted through the liquid crystal cell 12 and the lower polarizing plate 23, to the side of the liquid crystal cell 12.

Figure 3:
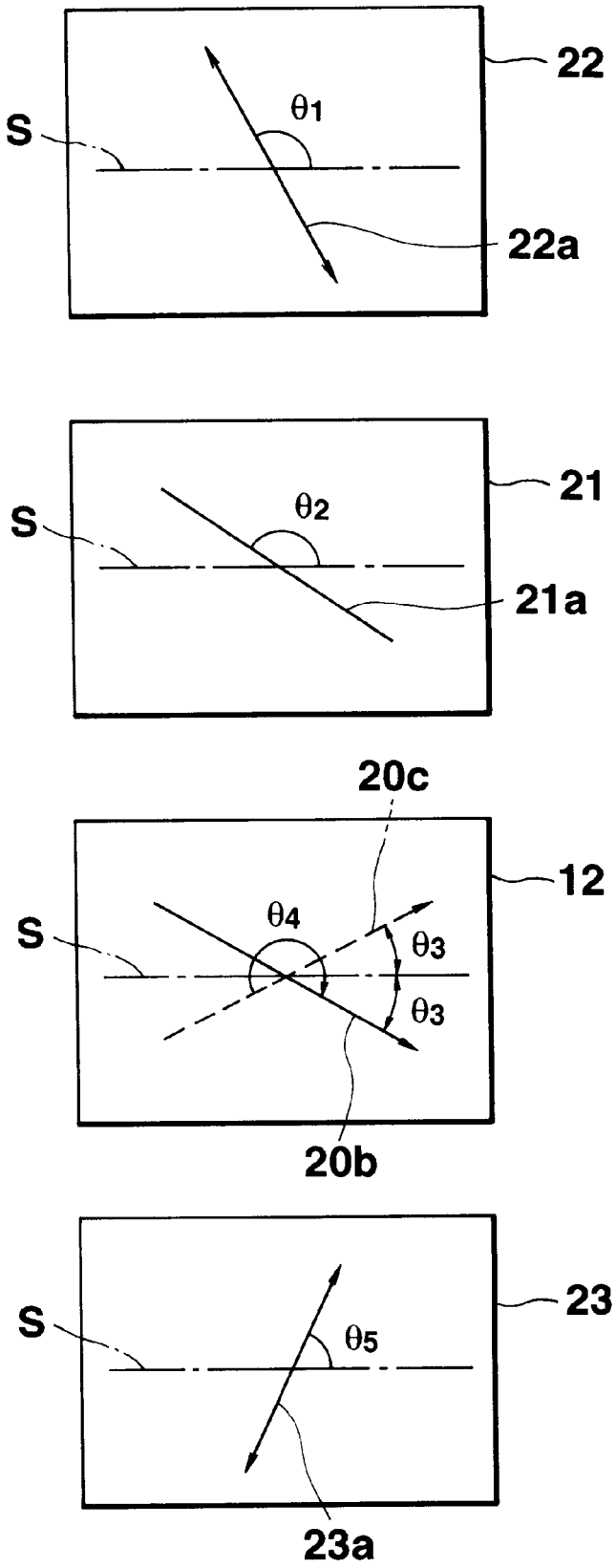
FIG. 3 is a diagram for explaining arrangements of optical axes of optical elements of the liquid crystal display element of the first embodiment.

FIG. 3 is a schematic diagram showing a combination of the aligning process direction of the liquid crystal cell 12, the optical axis of the retardation plate 21 and the transmission axes of the polarizing plates 22 and 23, in plan views of the respective elements.

In FIG. 3, lines 22*a* and 23*a* with double-headed arrows indicate transmission axes of the upper and lower polarizing plates 22 and 23, respectively. A line 21*a* indicates an optical axis of the retardation plate 21. Lines 20*b* and 20*c* with arrows respectively indicate aligning process directions of the upper and lower aligning films 17 and 18 in the liquid crystal cell 12.

A dot-chain line S in FIG. 3 is a reference line along the lateral direction on the display surface, drawn for the convenience of explanation.

The aligning process directions 20*b* and 20*c* are set at a predetermined angle $\theta_3$, upward and downward, with the reference line S, so that the liquid crystal has an aligning state in which molecules are arranged so as to be twist-aligned in a direction indicated by an arrow $\theta_4$ from the side of the lower glass substrate 14 toward the side of the upper glass substrate 13.

The optical axis 21*a* of the retardation plate 21 is a phase delay axis which crosses the reference line S at a predetermined angle $\theta_2$.

Further, in this embodiment, the transmission axes 22*a* and 23*a* of the upper and lower polarizing plates 22 and 23 respectively make angles $\theta_1$ and $\theta_5$ with the reference line S.

A coloring principle of the liquid crystal display element having the above structure will be described below.

A light applied from the above to the liquid crystal display panel 11 shown in FIG. 2 is converted to a linearly polarized light, while it is passing through the upper polarizing plate 22. Further, while the linearly polarized light is passing through the retardation plate 21, it is converted to an elliptically polarized light, which has different polarization states depending on the wavelengths, owing to a polarizing action in accordance with optical arrangement conditions (e.g., the position of the optical axis 21*a* of the retardation plate 21) and a retardation value. The elliptically polarized light, depending on the wavelength, further alters its polarization state, owing to a polarizing action in accordance with optical arrangement conditions of the liquid crystal cell 12 and a retardation value, while the light is passing through the liquid crystal cell 12.

When the elliptically polarized light having polarization components, which are different in polarization state depending on wavelengths, due to the polarizing action of the retardation plate 21 and the liquid crystal cell 12, is incident on the lower polarizing plate 23, a polarization component which coincides with the transmission axis 23*a* of the lower polarizing plate 23 is transmitted through the plate 23. For this reason, the light output from the lower polarizing plate 23 has a polarization component of a color corresponding to a long wavelength passed through the polarizing plate 23. The hue of the light is determined mainly by the retardation value of the retardation plate 21 and the retardation value of the liquid crystal cell 12.

The light passed through the lower polarizing plate 23 is reflected by the reflecting plate 24 and output to the side of the upper surface of the liquid crystal display panel in the route reverse to that in the aforementioned optical path. Accordingly, the color of the output light is displayed.

The retardation of the retardation plate 21 is a substantially constant value Δn·d ("Δn" represents the optical anisotropy of the retardation plate 21 and "d" represents the thickness of the plate). However, the retardation of the liquid crystal cell 12 varies depending on aligning states of liquid crystal molecules. The retardation of the liquid crystal cell 12 therefore is varied by changing the voltage applied to the liquid crystal cell 12, so that the aligning state of the liquid crystal molecules is changed, and accordingly the polarization action in the liquid crystal cell 12 is changed.

More specifically, when a voltage is not applied to the liquid crystal cell 12 (accurately, across the scan electrode 15 and the signal electrode 16), a light incident on the liquid crystal display panel 11 is affected by a polarization action of the retardation plate 21 and a polarization action of the liquid crystal molecules in accordance with the initial twist/alignment angle $\theta_4$, and converted to an elliptically polarized light in accordance with the polarization actions. The light, which has been transmitted through the lower polarizing plate 23, reflected by the reflecting plate 24 and output through the upper surface of the liquid crystal display panel 11 in the reverse route, has a color in accordance with the retardation of the retardation plate 21 and the retardation of the liquid crystal layer 20 aligned at the initial twist/alignment angle $\theta_4$.

When a voltage is applied across the electrodes 15 and 16 of the liquid crystal cell 12 and the effective voltage value is increased, the liquid crystal molecules gradually rise from the initial twist/aligning state. The retardation of the liquid crystal cell 12 is changed depending on the aligning state of the rising of the liquid crystal molecules. A light incident on the liquid crystal display panel 11 is affected by a polarization action of the retardation plate 21 and a polarization action in accordance with the changed retardation of the liquid crystal cell 12, and converted to an elliptically polarized light in accordance with the polarization actions. The displayed color is therefore different from the color obtained when no voltage is applied to the liquid crystal cell 12.

When a voltage, by which liquid crystal molecules are aligned substantially vertically, is applied to the liquid crystal cell 12, the retardation of the liquid crystal cell 12 is approximately 0. Since the liquid crystal cell 12 therefore performs substantially no polarization action, a light incident on the liquid crystal display panel 11 is converted to an elliptically polarized light only by the polarization action of the retardation plate 21. The elliptically polarized light passes through the lower polarizing plate 23, reflected by the reflecting plate 24 and output through the liquid crystal display panel 11 via the reverse route. The output light has a color in accordance with the retardation of the retardation plate 21.

The aforementioned angles $\theta_1$, $\theta_2$, $\theta_3$, $\theta_4$ and $\theta_5$ are set, for example, 95±10°, 140°±10°, 35°±10°, 250°±20° and 80°±10°, respectively.

The retardation of the retardation plate 21 is set to about 430 nm, the optical anisotropy Δn is set to about 0.13 and the thickness d of the liquid crystal layer is set to about 6.8 μm (accordingly, the retardation Δn·d is about 884 nm).

Figure 4:
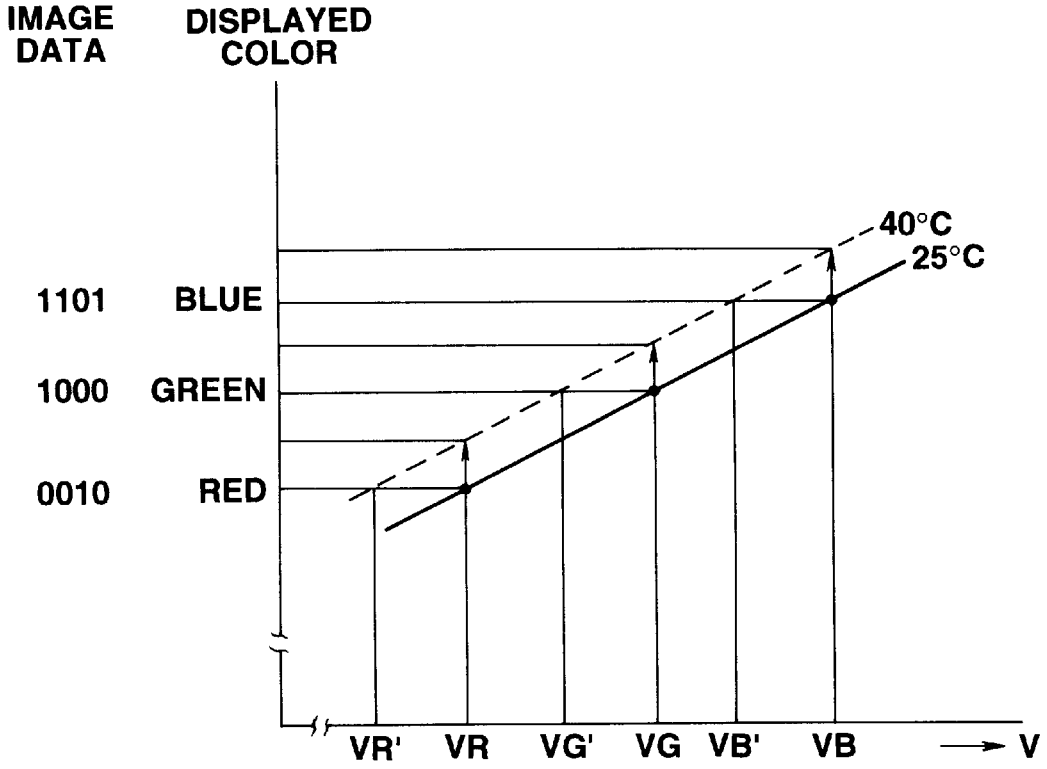
FIG. 4 is a graph showing the relationship between an applied voltage and a displayed color at different temperatures in the color liquid crystal display apparatus of the first embodiment.

The aligning state of liquid crystal molecules is changed in accordance with the temperature. For this reason, even if the same effective voltage is applied to the liquid crystal panel 11, different colors may be displayed depending on the temperatures, as shown in FIG. 4. In the example shown in FIG. 4, when the temperature is around 25° C., blue, green and red colors are obtained at the effective voltages VB, VG and VR (VB>VG>VR), respectively. When the temperature is around 40° C., blue, green and red colors are obtained at the effective voltages VB' (<VB), VG' (<VG) and VR' (<VR), respectively.

Therefore, when, for example, blue, green and red colors are to be displayed, color deviation due to a change in temperature can be suppressed by driving the liquid crystal display panel 11 so that the effective voltages in one display period, consisting of a predetermined number of frames, are VB, VG and VR, at the temperature around 25° C., and VB', VG' and VR' at the temperature around 40° C.

In this embodiment, the voltage applied to the signal electrodes 16 of the liquid crystal panel 11 is controlled in accordance with a change in temperature, thereby lowering the effective voltage in accordance with the rise in temperature. As a result, color deviation is suppressed to a degree which may not hinder practical use.

A structure of a driving circuit for driving the liquid crystal display panel 11 having the above structure will be described with reference to FIG. 5. The driving circuit of this embodiment is roughly divided into image data supplying means and drive controlling means. The image data supplying means includes an image memory 31 and a reading circuit 33. The image memory 31 stores four-bit image data which define the display color of each pixel of the liquid crystal display panel 11. In this embodiment, the image data "1101", "1000" and "0010" respectively designate blue, green and red. The other image data designate intermediate colors. Operations of generating image data and writing the data in the image memory 31 are executed by means of, for example, a CPU (central processing unit) which is not shown.

The reading circuit 33 successively reads out image data from the image memory 31 line by line in response to a timing signal supplied from a timing circuit 49 (to be described later), and supplies the read data to an applied voltage selecting circuit 35. The applied voltage selecting circuit 35 outputs applied voltage selecting signals S0 to S15 for selecting a voltage applied to the signal electrode 16, in order to display the color designated by the image data, in response to temperature data supplied from an A/D converter 43 (to be described later) and the image data supplied from the reading circuit 33.

The applied voltage selecting circuit 35 stores, in the form of a table as shown in FIG. 6, the relationship between image data and an applied voltage selecting signal for selecting a voltage to be applied to the signal electrode 16 to display the color defined by the image data at different temperatures. The circuit 35 outputs the applied voltage selecting signals S0 to S15 based on the stored data. For example, when the applied voltage selecting circuit 35 receives an image data "1101" designating "blue", it outputs an applied voltage selecting signal S13, if the temperature data indicates "below 32.5° C.". If the temperature data indicates "32.5° C. or higher", the circuit outputs an applied voltage selecting signal S11.

Figure 5:
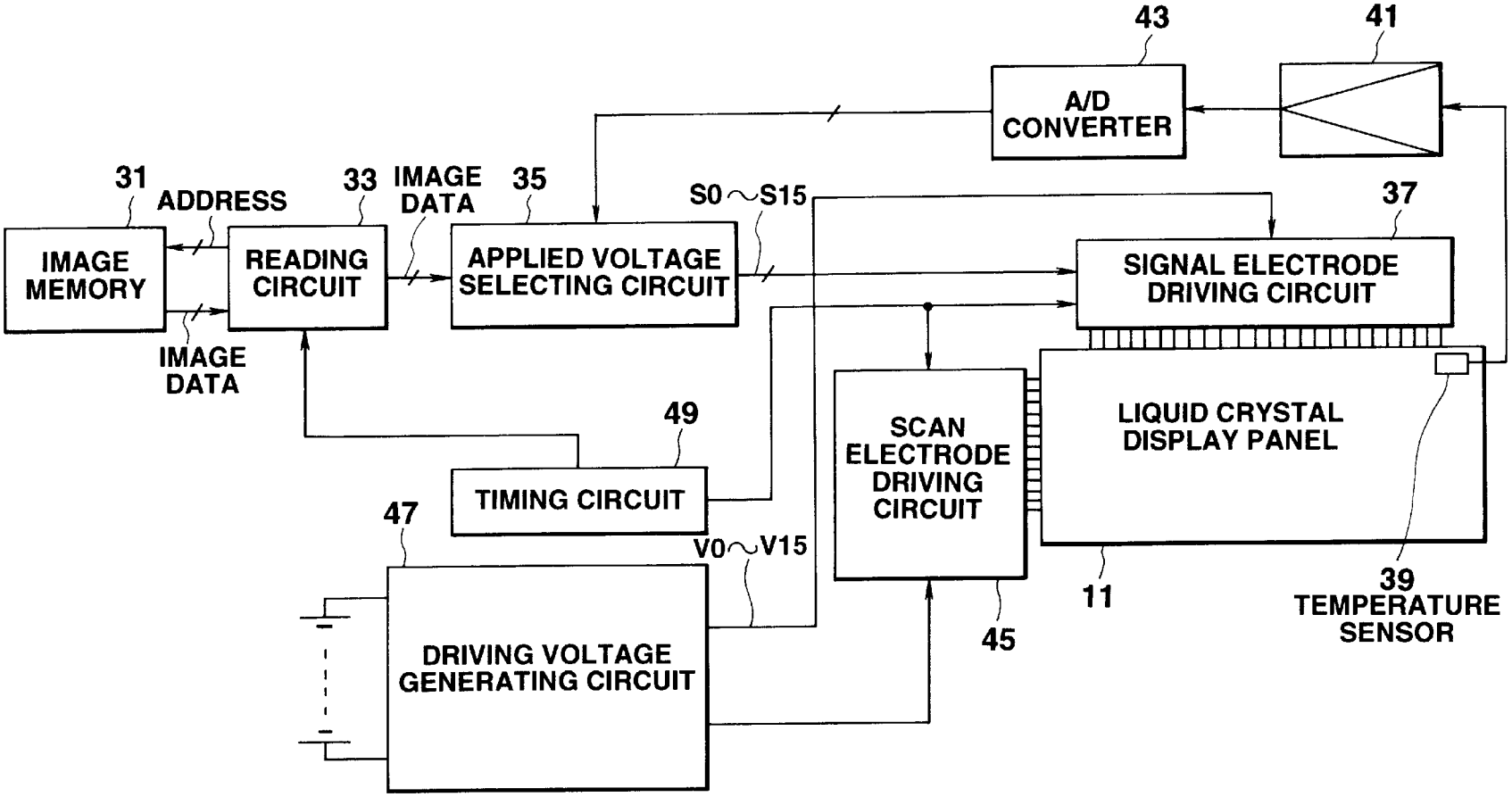
FIG. 5 is a block diagram showing a liquid crystal display element of the color liquid crystal display apparatus of the first embodiment and a driving circuit for driving the liquid crystal display element.

As shown in FIG. 5, the applied voltage selecting signals S0 to S15 output from the applied voltage selecting circuit 35 are supplied to a signal electrode driving circuit 37. The signal electrode driving circuit 37 successively fetches the applied voltage selecting signal for one line in response to a timing signal supplied from the timing circuit 49.

Further, 16 staged voltages V0 to V15, which are generated by a driving voltage generating circuit 47, are supplied to the signal electrode driving circuit 37.

The signal electrode driving circuit 37 selects a voltage from the voltages V0 to V15 in accordance with the applied voltage selecting signal fetched in a previous horizontal scanning period. The selected voltage is applied to the corresponding signal electrode 16 as a signal voltage.

A temperature sensor 39, comprised of a thermistor or a thermal couple, outputs an analog signal corresponding to the temperature of the liquid crystal display panel 11. An output signal from the temperature sensor 39 is amplified by an amplifier 41 and converted by the A/D converter 43 to digital temperature data, which is supplied to the applied voltage selecting circuit 35.

A scan electrode driving circuit 45 applies a scan voltage successively to the scan electrodes 15 of the liquid crystal display panel 11 in response to a timing signal supplied from the timing circuit 49.

The driving voltage generating circuit 47, comprised of a boosting circuit or a dividing circuit, generates a voltage (a selected voltage, a non-selected voltage) to be applied to the scan electrodes 15 of the liquid crystal display panel 11 and signal voltages V0 to V15 to be applied to the signal electrodes 16.

The signal voltages V0 to V15 are voltages, to be applied to the signal electrode 16, corresponding to the applied voltage selecting signals S0 to S15 respectively assigned to the image data "0000" to "1111" at a reference temperature (25° C.). For example, when a signal voltage V2 corresponding to an applied voltage selecting signal S2 is applied to the signal electrode 16, the effective voltage VR is given to the liquid crystal layer 20 of the corresponding pixel, so that a red display is obtained. When a signal voltage V8 corresponding to an applied voltage selecting signal S8 is applied to the signal electrode 16, the effective voltage VG is given to the liquid crystal layer 20 of the corresponding pixel, so that a green display is obtained. When a signal voltage V13 corresponding to an applied voltage selecting signal S13 is applied to the signal electrode 16, the effective voltage VB is given to the liquid crystal layer 20 of the corresponding pixel, so that a blue display is obtained.

Further, for example, when a signal voltage V0 is applied to the signal electrode 16, an effective voltage substantially equal to the voltage VR' is given to the liquid crystal layer 20 of the corresponding pixel. When a signal voltage V6 is applied to the signal electrode 16, an effective voltage substantially equal to the voltage VG' is given to the liquid crystal layer 20 of the corresponding pixel. When a signal voltage V11 is applied to the signal electrode 16, an effective voltage substantially equal to the voltage VB' is given to the liquid crystal layer 20 of the corresponding pixel.

Thus, at a temperature around 40° C., a display of the color designated by image data can be obtained, if a signal voltage, which is two-stage lower than the signal voltage at the temperature of 25° C., is selected and applied to the signal electrode 16.

The timing circuit 49 supplies timing control signals to the reading circuit 33, the signal electrode driving circuit 37 and the scan electrode driving circuit 45.

An operation of the liquid crystal display apparatus having the above structure will now be described.

First, the CPU or the like (not shown) successively writes image data, which define color images to be displayed, in the image memory 31, in accordance with the program.

The reading circuit 33 successively reads, line by line, image data stored in the image memory 31, in response to a timing signal supplied from the timing circuit 49. The read data are supplied to the applied voltage selecting circuit 35. The applied voltage selecting circuit 35 successively outputs the applied voltage selecting signals S0 to S15, corresponding to the supplied image data as indicated in the table shown in FIG. 6, in accordance with the temperature data (supplied from the A/D converter 43) representing the temperature of the liquid crystal display panel 11.

The signal electrode driving circuit 37 successively fetches applied voltage selecting signals supplied from the applied voltage selecting circuit 35. When the signal electrode driving circuit 37 receives an applied voltage selection signal for one scanning operation, it applies a voltage V0–V15, corresponding to the received selecting signal, to the corresponding signal electrode 16 as a signal voltage in response to a timing signal during the next horizontal scanning period.

The scan electrode driving circuit 45 switches the scan electrodes 15 in every scan period and applies a scanning signal to the corresponding scan electrode 15.

For this reason, a voltage, corresponding to the difference between the scan signal voltage and the applied signal voltage V0–V15, is applied to a portion (i.e., a pixel) of the liquid crystal layer at an intersection between the selected scan electrode and each signal electrode 16. A color corresponding to an effective voltage given in accordance with the applied voltage is displayed in the pixel.

When image data is "1000" designating "green" and the temperature is 25° C., the applied voltage selecting circuit 35 outputs an applied voltage selecting signal S8 in accordance with the content of the table. The signal electrode driving circuit 37 selects a signal voltage V8 from the signal voltages V0 to V15 and applies it to the corresponding signal electrode 16. In this case, as described above, an effective voltage given to the liquid crystal layer 20 of the corresponding pixel is VG, with the result that the green color designated by the image data is displayed. On the other hand, when image data is "1000" and the temperature is 40° C., the applied voltage selecting circuit 35 outputs an applied voltage selecting signal S6 in accordance with the content of the table. The signal electrode driving circuit 37 selects a signal S6, two-stage lower than the signal voltage V8, and applies it to the corresponding signal electrode 16. In this case, as described above, an effective voltage given to the liquid crystal layer 20 of the corresponding pixel is substantially VG', with the result that the green color designated by the image data is displayed.

Similarly, when image data is "0010" designating "red" and the temperature is 25° C., the applied voltage selecting circuit 35 outputs an applied voltage selecting signal S2. The signal electrode driving circuit 37 applies a signal voltage V2 to the corresponding signal electrode 16. In this case, an effective voltage given to the liquid crystal layer 20 of the corresponding pixel is VR, with the result that the red color designated by the image data is displayed. On the other hand, when image data is "0010" and the temperature is 40° C., the applied voltage selecting circuit 35 outputs an applied voltage selecting signal S0. The signal electrode driving circuit 37 selects a signal S0, two-stage lower than the signal voltage V2, and applies it to the corresponding signal electrode 16. In this case, an effective voltage given to the liquid crystal layer 20 of the corresponding pixel is substantially VR', with the result that the red color designated by the image data is displayed.

As described above, in this embodiment, even if the same image data is supplied, a suitable one is selected from the 16-stage voltages V0 to V15 in accordance with a change in temperature and applied to the signal electrode 16. As a result, an effective voltage given to the liquid crystal layer 20 is controlled, so that the color designated by the image data can be displayed. Thus, color deviation due to a change in temperature can be prevented.

In addition, a voltage to be applied to the signal electrode 16 is selected from the 16 stage signal voltages V0 to V16, so as to provide an effective voltage corresponding to the color to be displayed. Since it is thus unnecessary to additionally generate a voltage to be applied, the circuit structure is simple.

In the above embodiment, the temperature of the liquid crystal display panel is divided into two ranges: at least 32.5° C. and below that, and the signal voltage applied to the signal electrode 16 is controlled in the respective ranges. However, the signal voltage applied to the signal electrode 16 may be controlled in more detailed ranges. For example, as shown in FIG. 7, assuming that the reference temperature of the liquid crystal display panel 11 is 25° C., a signal voltage one-stage higher than the reference voltage is applied to the signal electrode 16 at a temperature below 20° C., the reference signal voltage is applied to the signal electrode 16 at a temperature of at least 20° C. and below 30° C., a signal voltage one-stage lower than the reference voltage is applied to the signal electrode 16 at a temperature of at least 30° C. and below 40° C., and a signal voltage two-stage lower than the reference voltage is applied to the signal electrode 16 at a temperature of 40° C. or higher.

The signal voltage to be selected in accordance with the temperature and the image data is determined by, for example, an experiment, depending on the characteristics of the liquid crystal display panel 11 and the number of pulse voltages generated by the driving voltage generating circuit 47.

Although the embodiment using the 4-bit image data and the 16 stage signal voltages has been described above, image data of any number of bits and any number of signal voltages can be employed.

Although the embodiment, in which an STN liquid crystal display element of a simple matrix system is driven in a time-divisional manner, has been described above, the present application can be applied to a liquid crystal display element of an active matrix system, using a TFT (thin film transistor) or the like as a switching active element. In this case, a voltage, applied to each of the pixel electrodes through a data line and an active element, is changed in accordance with the image data and the temperature.

In the above embodiment, the voltage (signal voltage) applied to the signal electrode is controlled in accordance with the image data and the temperature data. However, the present invention can be applied to a liquid crystal display element having a driving unit of a PWM (pulse width modulation) system for controlling a displayed color by controlling the pulse width of a signal voltage.

Figure 8:
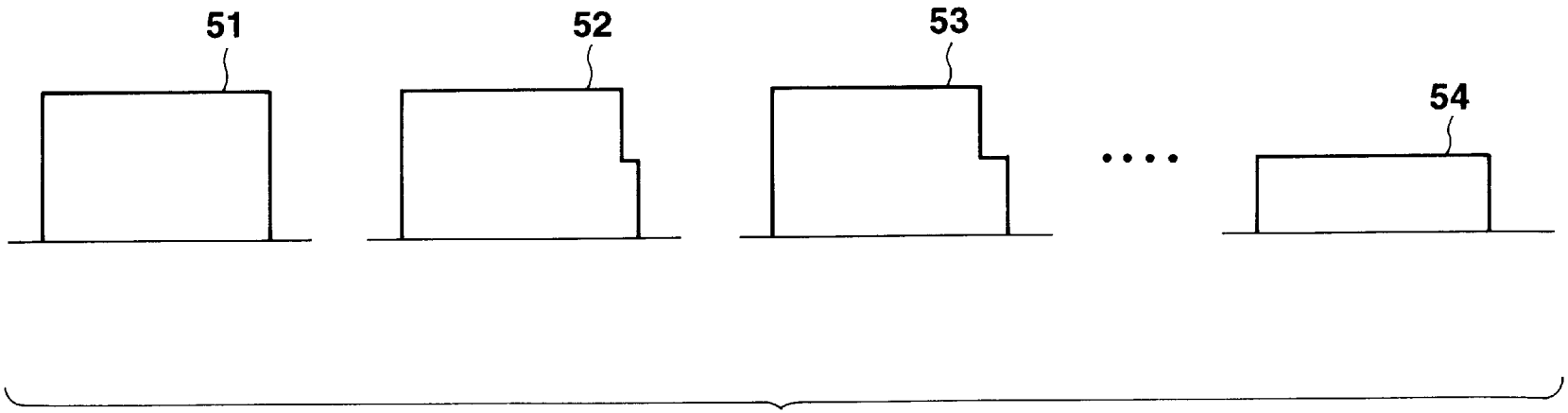
FIG. 8 is a waveform diagram showing a signal voltage generated when the color liquid crystal display apparatus of the present invention is driven by a PWM system.

For example, the present invention can be applied to a liquid crystal display apparatus of the PWM driving system of a type of obtaining 16-staged effective voltages by combining pulse voltages having the waveforms, as shown in FIG. 8, ranging from the pulse voltage having a high effective voltage as indicated by a reference numeral 51 to the pulse voltage having a minimum effective voltage as indicated by a reference numeral 54. In this case, when the image data designates a waveform 52, if the temperature indicated by the temperature data is higher than the reference temperature, a waveform 53 is selected (or generated) by the signal electrode driving circuit 37 and supplied to the signal electrode 15, so that a lower effective voltage can be given to the liquid crystal. In contrast, if the temperature indicated by the temperature data is lower than the reference temperature, a waveform 51 is selected and supplied to the signal electrode 15, so that a higher effective voltage can be given to the liquid crystal.

The waveforms shown in FIG. 8 are merely examples and the present invention is not limited thereto.

The point is to lower the effective voltage applied to the liquid crystal in one display period in accordance with an increase in the temperature and to raise it in accordance with a decrease in the temperature, so that the same color can be displayed in reply to the same image data, irrespective of the change in temperature.

Second Embodiment

According to a second embodiment of the present invention, there is provided a color liquid crystal display apparatus in which a desired display color can be obtained, irrespective of the change in source voltage for generating a voltage to be applied to the liquid crystal. In the following description, the same elements as described in the first embodiment are identified with the same reference numerals and a description thereof is omitted.

In the color liquid crystal display apparatus of the second embodiment, the same liquid crystal display panel as in the first embodiment is used. Therefore, the coloring principle of the liquid crystal display panel is also the same as that of the first embodiment. In the liquid crystal display panel of this embodiment, effective voltages applied to the liquid crystal layer to display blue, green and red colors are assumed to be VB, VG and VR (VB>VG>VR), respectively.

A structure of a driving circuit for driving the liquid crystal display panel 11 will be described with reference to FIG. 9.

Figure 9:
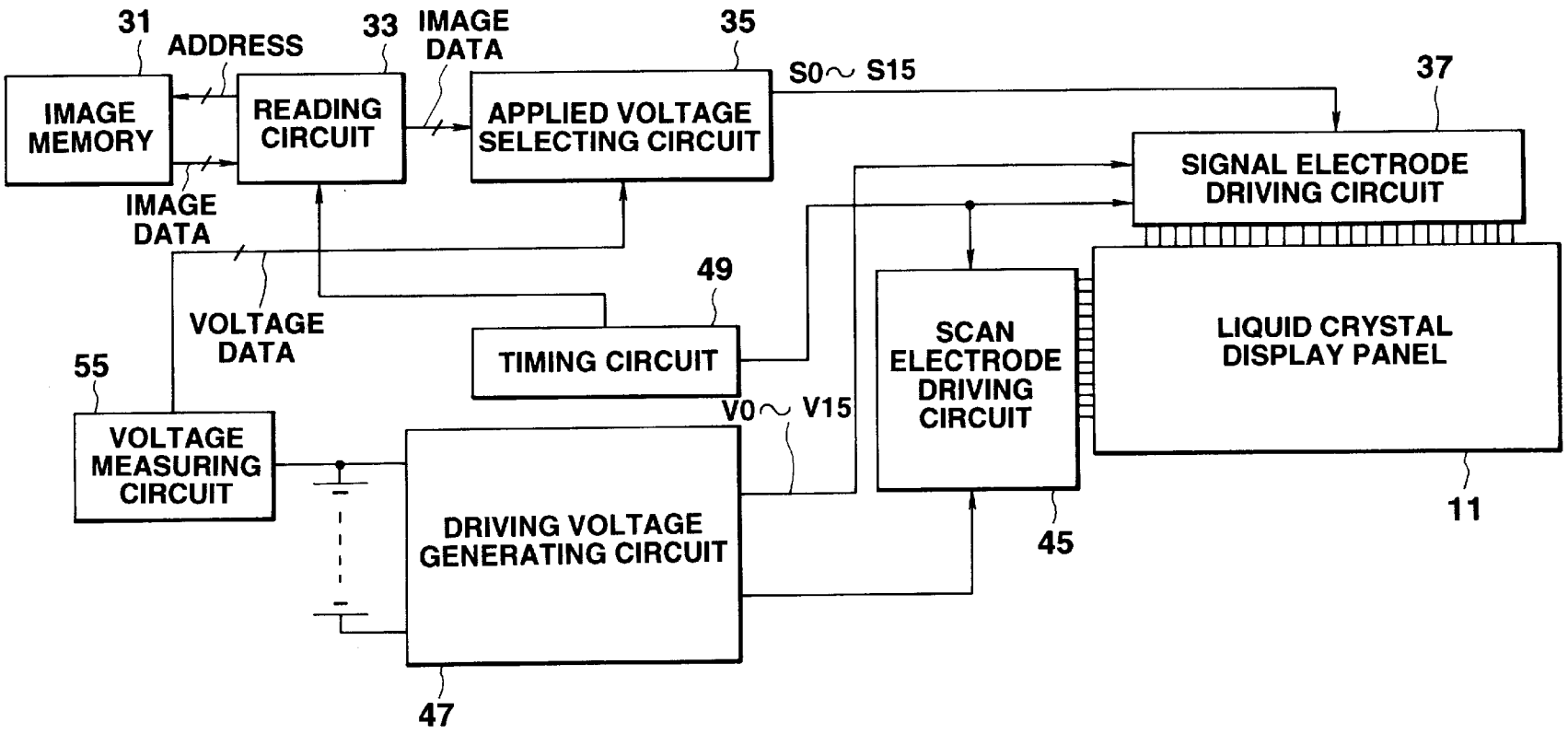
FIG. 9 is a block diagram showing a liquid crystal display element of the color liquid crystal display apparatus of a second embodiment and a driving circuit for driving the liquid crystal display element.

In the structure of FIG. 9, an image memory 31 stores 4-bit image data which defines the display color of each pixel of the liquid crystal display panel 11. In this embodiment, the image data "1101", "1000" and "0010" respectively designate blue, green and red. The other image data designate intermediate colors. Operations of generating image data and writing the data in the image memory 31 are executed by means of, for example, a CPU (central processing unit) which is not shown.

A reading circuit 33 successively reads out image data from the image memory 31 line by line in response to a timing signal supplied from a timing circuit 49 (to be described later), and supplies the read data to an applied voltage selecting circuit 35. The applied voltage selecting circuit 35 outputs applied voltage selecting signals S0 to S15 corresponding to voltage selecting data for selecting a voltage applied to a signal electrode 16, in order to display the color designated by the image data, in response to voltage data supplied from a voltage measuring circuit 55 (to be described later) and the image data supplied from the reading circuit 33.

The applied voltage selecting circuit 35 stores, in the form of a table as shown in FIG. 10, the relationship between image data and an applied voltage selecting signal for selecting a voltage to be applied to the signal electrode 16 to display the color defined by the image data at different ratios of the change in source voltage. The applied voltage selecting circuit 35 outputs the applied voltage selecting signals S0 to S15 based on the stored data. For example, when the applied voltage selecting circuit 35 receives an image data "0010" designating "red", it outputs an applied voltage selecting signal S2, if the source voltage is a normal value (the ratio of the change is less than ±3.5%). If the source voltage is at least 3.5% higher than the normal value, the circuit 35 outputs an applied voltage selecting signal S1. If the source voltage is at least 3.5% lower than the normal value, the circuit 35 outputs an applied voltage selecting signal S3.

As shown in FIG. 9, the applied voltage selecting signals S0 to S15 output from the applied voltage selecting circuit 35 are supplied to a signal electrode driving circuit 37. The signal electrode driving circuit 37 successively fetches the applied voltage selecting signal for one line in response to a timing signal supplied from the timing circuit 49.

Further, 16-staged voltages V0 to V15, which are generated by a driving voltage generating circuit 47, are supplied to the signal electrode driving circuit 37.

The signal electrode driving circuit 37 selects a voltage from the voltages V0 to V15 in accordance with the applied voltage selecting signal fetched in a previous horizontal scanning period. The selected voltage is applied to the corresponding signal electrode 16.

A scan electrode driving circuit 45 applies a scan voltage successively to the scan electrodes 15 of the liquid crystal display panel 11 in response to a timing signal supplied from the timing circuit 49.

A driving voltage generating circuit 47 generates signal voltages V0 to V15 applied to the signal electrodes 16 of the liquid crystal display panel 11 in order to control the displayed color, and selected and non-selected voltages applied to the scanning electrodes 15.

The driving voltage generating circuit 47 is comprised of a boosting circuit or a dividing circuit for boosting or dividing a source voltage supplied from the power source, such as a battery or an AC/DC converter. The signal voltages V0 to V15 generated by the driving voltage generating circuit 47 have different voltages of 16-stages obtained by dividing the source voltage, and are accordingly changed in accordance with the change in source voltage as shown in FIG. 11.

Figure 11:
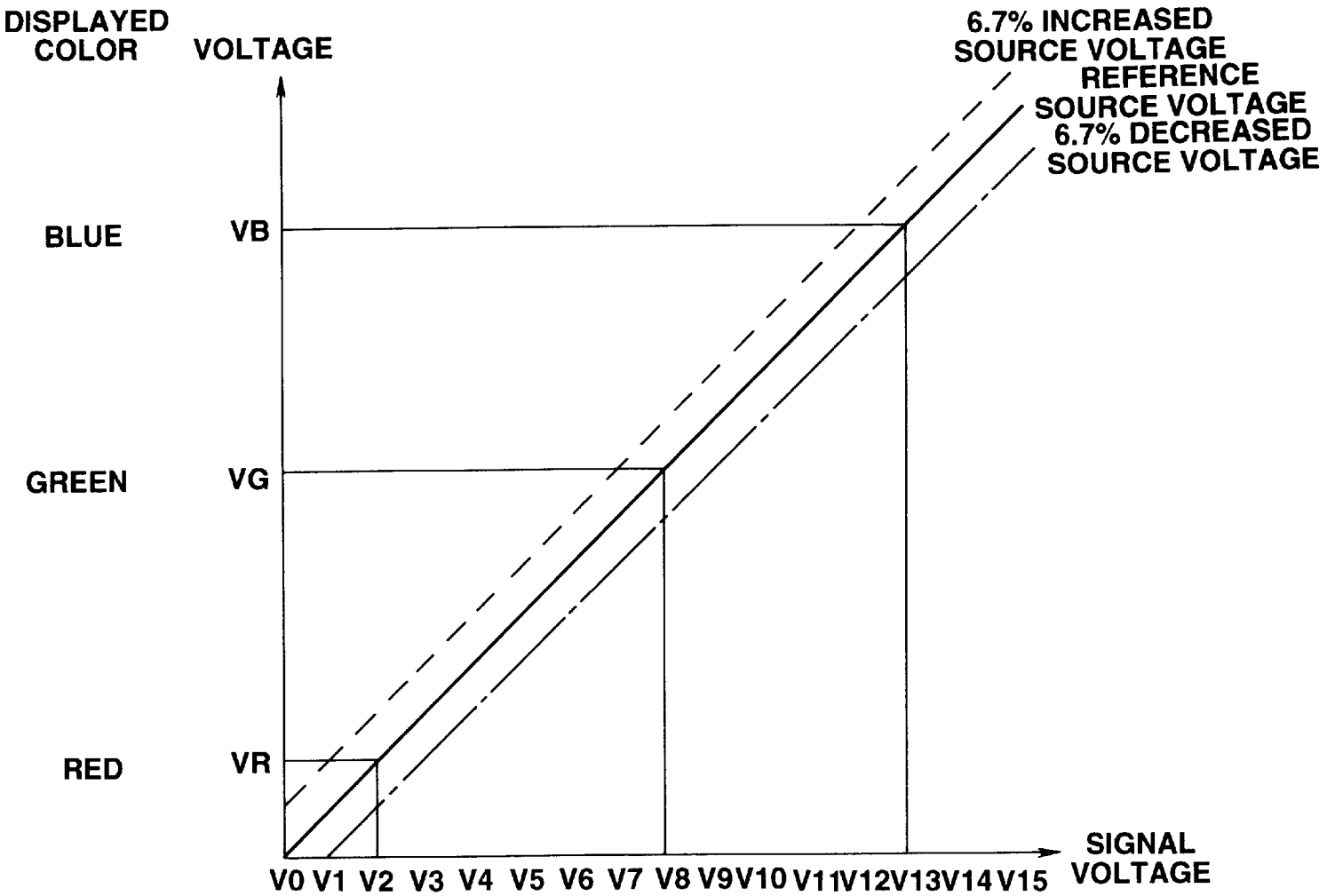
FIG. 11 is a graph showing the relationship among a source voltage, a signal voltage and a displayed color in the color liquid crystal display apparatus of the second embodiment.

In this embodiment, as shown in FIG. 11, when the source voltage is a normal value, a signal voltage V2 is applied to the signal electrode 16, the effective voltage VR is given to the liquid crystal layer 20 of the corresponding pixel, so that a red display is obtained. When a signal voltage V8 is applied to the signal electrode 16, the effective voltage VG is given to the liquid crystal layer 20 of the corresponding pixel, so that a green display is obtained. When a signal voltage V13 is applied to the signal electrode 16, the effective voltage VB is given to the liquid crystal layer 20 of the corresponding pixel, so that a blue display is obtained.

The voltage measuring circuit 55 measures the source voltage and supplies digital data corresponding to the measured value to applied voltage selecting circuit 35.

The timing circuit 49 supplies timing control signals to the reading circuit 33, the signal electrode driving circuit 37 and the scan electrode driving circuit 45.

An operation of the liquid crystal display apparatus having the above structure will now be described.

First, the CPU or the like (not shown) successively writes image data, which define color images to be displayed, in the image memory 31, in accordance with the program.

The reading circuit 33 successively reads, line by line, image data stored in the image memory 31, in response to a timing signal supplied from the timing circuit 49. The read data is supplied to the applied voltage selecting circuit 35. The applied voltage selecting circuit 35 successively outputs the applied voltage selecting signals S0 to S15, corresponding to the supplied image data as indicated in the table shown in FIG. 10, in accordance with the data representing the source voltage supplied from the voltage measuring circuit 55.

The signal electrode driving circuit 37 successively fetches applied voltage selecting signals supplied from the applied voltage selecting circuit 35. When the signal electrode driving circuit 37 receives an applied voltage selecting signal for one scanning period, it applies a voltage V0–V15, corresponding to the received selecting signal, to the corresponding signal electrode 16 as a signal voltage in response to a timing signal during the next horizontal scanning period.

The scan electrode driving circuit 45 applies a scanning signal to each of the scan electrodes 15 in every scan period.

For this reason, a voltage, corresponding to the difference between the voltages applied to the opposing electrodes 15 and 16, is applied to the portion of the liquid crystal layer 20 at an intersection between the selected scan electrode and each signal electrode 16. A color corresponding to an effective voltage determined in accordance with the applied voltage is displayed.

For example, when image data is "1000" designating "green" and the source voltage is the reference value, the applied voltage selecting circuit 35 outputs an applied voltage selecting signal S8 in accordance with the content of the table. The signal electrode driving circuit 37 selects a signal voltage V8 from the signal voltages V0 to V15 and applies it to the corresponding signal electrode 16. In this case, an effective voltage given to the portion of the liquid crystal layer 20 of the corresponding pixel is VG, with the result that the green color designated by the image data is displayed.

On the other hand, when image data is "1000" and the source voltage is at least 3.5% (e.g., 5%) lower than the reference value, the applied voltage selecting circuit 35 outputs an applied voltage selecting signal S9 in accordance with the content of the table. The signal electrode driving circuit 37 selects a signal voltage V9 corresponding to the applied voltage selecting signal S9, and applies it to the corresponding signal electrode 16. Since the signal voltage V9 is lower than the normal value (reference value) due to the drop of the source voltage, it is substantially equal to the signal voltage V8 in the normal state, as shown in FIG. 11. Therefore, an effective voltage applied to the liquid crystal layer 20 of the corresponding pixel is substantially VG, with the result that the green color designated by the image data is displayed.

When image data is "1000" and the source voltage is at least 3.5% (e.g., 6%) higher than the reference value, the applied voltage selecting circuit 35 outputs an applied voltage selecting signal S7 in accordance with the content of the table. The signal electrode driving circuit 37 selects a signal voltage V7 accordingly and applies it to the corresponding signal electrode 16. Since the signal voltage V7 is higher than the normal value (reference value) due to the rise of the source voltage, it is substantially equal to the signal voltage V8 in the normal state, as shown in FIG. 11. Therefore, an effective voltage applied to the liquid crystal layer 20 of the corresponding pixel is substantially VG, with the result that the green color designated by the image data is displayed.

Similarly, when image data is "0010" designating "red" and the source voltage is the reference value, the applied voltage selecting circuit 35 outputs an applied voltage selecting signal S2. The signal electrode driving circuit 37 selects a signal voltage V2 and applies it to the corresponding signal electrode 16. An effective voltage applied to the liquid crystal layer 20 of the corresponding pixel is substantially VR, with the result that the red color designated by the image data is displayed.

On the other hand, when image data is "0010" and the source voltage is, for example, 4% lower than the reference value, the applied voltage selecting circuit 35 outputs an applied voltage selecting signal S3 in accordance with the content of the table. The signal electrode driving circuit 37 selects a signal voltage V3 and applies it to the corresponding signal electrode 16. Since the signal voltage V3 is lower than the normal value due to the drop of the source voltage, it is substantially equal to the signal voltage V2 in the normal state, as shown in FIG. 11. Therefore, an effective voltage applied to the liquid crystal layer 20 of the corresponding pixel is substantially VR, with the result that the red color designated by the image data is displayed.

When image data is "0010" and the source voltage is, for example 7% higher than the reference value, the applied voltage selecting circuit 35 outputs an applied voltage selecting signal S1 in accordance with the content of the table. The signal electrode driving circuit 37 selects a signal voltage V1 and applies it to the corresponding signal electrode 16. Since the signal voltage V1 is higher than the normal value due to the rise of the source voltage, it is substantially equal to the signal voltage V2 in the normal state, as shown in FIG. 11. Therefore, an effective voltage applied to the liquid crystal layer 20 of the corresponding pixel is substantially VR, with the result that the red color designated by the image data is displayed.

As described above, in this embodiment, a suitable voltage to display the color designated by image data is selected from the 16-stage voltages V0 to V15 in accordance with a change in source voltage to compensate influences due to the change and applied to the signal electrode 16. As a result, color deviation due to a change in temperature can be suppressed.

In addition, a change in source voltage can be compensated simply by selecting a voltage to be applied to the signal electrode 16 from the 16 stage signal voltages V0 to V15 in accordance with the image data and source voltage. Since it is thus unnecessary to additionally generate a voltage to be applied, the circuit structure is simple.

In this embodiment, the voltage value itself applied to the signal electrode is controlled in accordance with the image data and the voltage data. However, as in the first embodiment, the invention according to the second embodiment can also be applied to a liquid crystal display element having a driving unit of a PWM (pulse width modulation) system for controlling a displayed color by controlling the pulse width of a signal voltage.

Third Embodiment

A third embodiment of the present invention is to detect a difference between a displayed color and a color defined by input image data, i.e., a color deviation, and select a signal voltage in accordance with the color deviation, thereby obtaining a desired color display in which the color deviation is corrected.

In a color liquid crystal display apparatus of the third embodiment, the same liquid crystal display panel as that of the first embodiment is used as a liquid crystal display element. The coloring principle is therefore the same as that of the first embodiment.

The structure of a driving circuit for driving the liquid crystal display panel of the third embodiment is the same as that of the first embodiment, except that the system for detecting the temperature of the liquid crystal display panel of the first embodiment is replaced with a system for detecting a color difference between a displayed color and a defined color.

Figure 12:
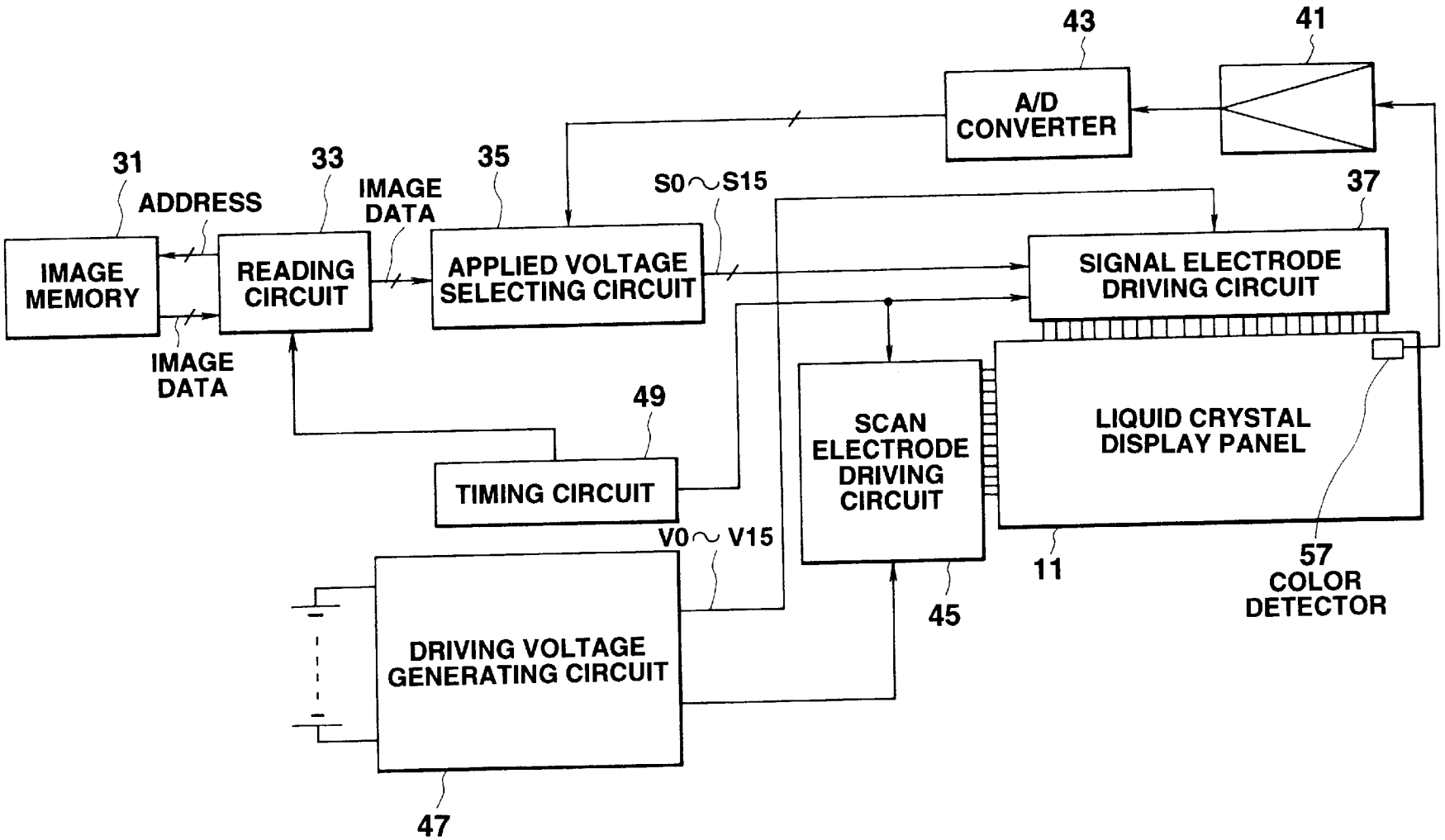
FIG. 12 is a block diagram showing a liquid crystal display element of the color liquid crystal display apparatus of a third embodiment and a driving circuit for driving the liquid crystal display element.

As shown in FIG. 12, a color detector 57 for detecting the color of the liquid crystal is arranged in a corner portion, out of the image forming region of the liquid crystal display panel 11. A correction detecting region of the liquid crystal display panel, in which the color detector 57 is arranged, is constructed in the same manner as in the image forming region. A voltage is applied to the correction detecting region in accordance with the special color data peculiar to the region, thereby assuming the color corresponding to the color data. The color detector 57 detects the color in the correction detecting region. For example, a spectral analyzer is suitable for the color detector. The color detector 57 is connected to the applied voltage detecting circuit 35 through an amplifier 41 and an A/D converter 43 and outputs color detection data.

The applied voltage selecting circuit 35 stores the relationship between image data and an applied voltage selecting signal for displaying the color defined by the image data in a table as shown in FIG. 13 in ranges suitable for, e.g., wavelengths of light representing the color of the correction detecting region. Not only the wavelength but also various physical characteristic values, such as a refraction factor or transmission factor of light, can be used as parameters for detecting the color of light.

A color correcting operation of the aforementioned driving circuit will now be described.

A color detection signal output from the color detector 57 is amplified by the amplifier 41, converted by the A/D converter 43 to digital color detection data, and supplied to the applied voltage detection circuit 35. The applied voltage detection circuit 35 successively outputs applied voltage selection signals S0 to S15 corresponding to the supplied image data in accordance with the color detection data supplied from the A/D converter 43.

In this case, predetermined color data defining "green" is always supplied to the correction detecting region, and a voltage corresponding to the color data is selected from the signal voltages V0 to V15 supplied from the driving voltage generating circuit 47 and applied to the correction detecting region. Therefore, when the source voltage or the temperature of the liquid crystal display panel is changed, the displayed color of the correction detecting region is also changed accordingly. For example, when the temperature of the liquid crystal display panel rises, the displayed color of the correction detecting region is shifted to the side of "blue" as shown in FIG. 4. The applied voltage selection circuit, which receives the color detection data shifted to the side of "blue", selects as an applied voltage detecting signal corresponding to the image data a voltage selecting signal one-stage lower than that of the normal state in accordance with the table shown in FIG. 13. The normal state is a state in which the correction detecting region is indicated as "green" and the wavelength data measured in the color detector 57 is 495 to 530 nm.

For example, when the image data supplied to a pixel is "0010" designating "red", if the wavelength of the detected light in the correction detecting region is 495 nm or shorter, i.e., the color of the detected light is shifted to the side of "blue", the applied voltage selecting circuit 35 outputs an applied voltage selecting signal S1 in accordance with the contents of the table. The signal electrode driving circuit 37, which receives the applied voltage selecting signal S1, selects the signal voltage V1 from the signal voltages V0 to V15, and applies it to the signal electrode of the pixel. As a result, the effective voltage given to the liquid crystal layer of the pixel becomes VR, so that the red color designated by the image data is displayed in the pixel.

Although the 4-bit image data and the 16-staged signal voltages are used in the first to third embodiments, image data of any number of bits and any number of signal voltages can be employed.

The signal voltage to be selected in accordance with the temperature and the image data is determined by, for example, an experiment, depending on the characteristics of the liquid crystal display panel 11 and the number of voltages generated by the driving voltage generating circuit 47.

A twisted nematic liquid crystal display element of a simple matrix system, driven in a time-divisional manner, has been described above as the embodiments. However, the present application can also be applied to a twisted nematic liquid crystal display element of an active matrix system, using a TFT (thin film transistor) or the like as a switching active element. In this case, a voltage, applied to each of the pixel electrodes through a data line and an active element, is changed in accordance with the image data and the correction signal such as a source voltage.

Further, in the above embodiments, the twist/alignment angle of the liquid crystal cell 12 is 180 to 270° and the retardation $\Delta n \cdot d$ is about 700 to 1100 nm. However, the characteristics can be modified: for example, the twist/alignment angle can be 90 to 180° and the retardation $\Delta n \cdot d$ can be 1100 nm or greater.

That is, the present invention may be suitable for various combinations of liquid crystal and retardation plate.

Moreover, the present invention can be widely applied to all liquid crystal display panels of the type in which a displayed color is changed by controlling an applied voltage so as to control birefringence. For example, it can be applied to a color liquid crystal display apparatus of the normal ECB (electrically controlled birefringence) system.

Furthermore, although the aforementioned embodiments use the reflection type liquid crystal display panel 11 having the reflection plate 24, the present invention can be applied to a liquid crystal display apparatus of a transmission type or a semi-transmission type.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A color liquid crystal display apparatus comprising:

a liquid crystal display element for displaying a color image including a plurality of colors, in which a birefringence action of liquid crystal is controlled by applying a voltage to the liquid crystal;

image data supplying means for supplying image data defining a display color; and drive control means, in which a plurality of voltage stages corresponding to said plurality of colors are preset with respect to a source voltage to generate a voltage to be applied to the liquid crystal display element, for:

selecting a voltage stage from the plurality of voltage stages in accordance with the image data supplied from the image data supplying means, applying a voltage corresponding to the selected voltage stage to the liquid crystal display element, to cause the liquid crystal display element to display a display color defined by the image data, and changing the voltage stage to another voltage stage for obtaining a different effective voltage to be applied to the liquid crystal display element in order to continue to display the display color defined by the image data, to compensate a color difference between a color displayed in the liquid crystal element and the display color defined by the image data, caused by a change in driving conditions of the liquid crystal, so that said color displayed in the liquid crystal in response to said image data which defines the display color, cannot substantially change.

2. The color liquid crystal display apparatus according to claim 1, wherein the drive control means, in which a plurality of voltage stages are preset corresponding to said driving conditions, comprises control means for selectively applying, to liquid crystal of the pixel corresponding to a piece of image data, at least two signal voltages corresponding to at least two voltage stages determined in advance for at least one display color.

3. The color liquid crystal display apparatus according to claim 1, wherein the drive control means, in which a plurality of voltage stages are preset corresponding to said driving conditions, comprises control means for selectively applying, to liquid crystal of the pixel corresponding to a piece of image data, a plurality of signal voltages corresponding to a plurality of voltage stages determined in advance for different display colors in one-to-one correspondence or at least two signal voltages corresponding to at least two voltage stages determined in advance for at least one display color.

4. The color liquid crystal display apparatus according to claim 1, wherein the drive control means comprises:

detecting means for detecting said change in driving conditions of the liquid crystal display element and outputting a correction signal; and control means for receiving the correction signal output from the detecting means and the image data supplied from the image data supplying means, and selectively applying at least two signal voltages corresponding to at least two voltage stages determined in advance for at least one display color to the pixel of the liquid crystal display element in accordance with the correction signal, so that the display color defined by the image data substantially coincides with the color displayed in the liquid crystal display element.

5. The color liquid crystal display apparatus according to claim 1, wherein the drive control means comprises:

detecting means for detecting a difference between the display color defined by a piece of image data and the color displayed in the liquid crystal display element and outputting a correction signal;

a voltage generating circuit for generating signal voltages of a number greater than a number of the plurality of display colors defined by the image data supplied from the image data supplying means; and control means for receiving the correction signal output from the detecting means and the image data supplied from the image data supplying means and selectively applying a signal voltage output from the voltage generating circuit to the pixel of the liquid crystal display element in accordance with the correction signal, so that the display color defined by the image data substantially coincides with the color displayed in the liquid crystal display element.

6. The color liquid crystal display apparatus according to claim 1, wherein the drive control means comprises:

detecting means for detecting a temperature of the liquid crystal display element and outputting a correction signal; and control means for receiving the correction signal output from the detecting means and the image data supplied from the image data supplying means and selectively applying voltages for displaying substantially the same color as the display color defined by the image data to the pixel of the liquid crystal display element in accordance with the correction signal.

7. The liquid crystal display apparatus according to claim 6, wherein the control means prepares a plurality of voltage stages corresponding to different temperatures of the liquid crystal display element in accordance with the display color defined by the one piece of image data, and selects one of the plurality of voltage stages in accordance with the correction signal and applies a signal voltage corresponding to the selected signal voltage stage to liquid crystal of the pixel.

8. The color liquid crystal display apparatus according to claim 6, wherein the control means comprises:

storage means for storing voltage stages in accordance with the display color defined by the image data in each of a plurality of temperature ranges of the liquid crystal display element; and voltage applying means for reading from the storage means a voltage stage corresponding to the image data and the correction signal, and applying a signal voltage corresponding to the selected signal voltage stage to the pixels.

9. The color liquid crystal display apparatus according to claim 1, wherein the drive control means comprises:

detecting means for detecting the source voltage for generating a voltage to be applied to the liquid crystal display element and outputting a correction signal; and control means for receiving the correction signal output from the detecting means and the image data supplied from the image data supplying means and selectively applying voltages for displaying substantially the same color as the display color defined by the image data to a pixel of the liquid crystal display element in accordance with the correction signal.

10. The color liquid crystal display apparatus according to claim 9, wherein the control means prepares a plurality of voltage stages corresponding to different ranges of the source voltage in accordance with the display color defined by a piece of image data, selects one of the plurality of voltage stages in accordance with the correction signal, and applies a signal voltage corresponding to the selected signal voltage stage to liquid crystal of the pixel.

11. The color liquid crystal display apparatus according to claim 9, wherein the control means comprises:

storage means for storing voltage stages in accordance with the display color defined by the image data in each of a plurality of voltage ranges of the source voltage; and voltage applying means for reading from the storage means a voltage stage corresponding to the image data and the correction signal, and applying a signal voltage corresponding to the selected signal voltage stage to the pixels.

12. The color liquid crystal display apparatus according to claim 1, wherein said liquid crystal is of a twisted nematic type containing liquid crystal molecules aligned in a twisted manner.

13. A method for driving a color liquid crystal display apparatus comprising a liquid crystal display element, including liquid crystal for displaying a plurality of colors in accordance with a voltage applied to each of pixels, wherein a birefringence action of the liquid crystal is controlled by applying a voltage to the liquid crystal, the method comprising:

preparing a plurality of voltage stages corresponding to each of different display colors to be displayed in the liquid crystal display element, the voltage stages being preset with respect to a source voltage to generate a voltage to be applied to the liquid crystal display element;

selecting a voltage stage from the plurality of voltage stages in accordance with the display color of said image data supplied from the image data supplying means; and (i) applying a signal voltage corresponding to the selected voltage stage to the liquid crystal display element, to cause the liquid crystal display element to display a display color defined by the image data, and (ii) changing the voltage stage to another voltage stage for obtaining an effective voltage to be applied to the liquid crystal display element in order to continue to display the display color defined by the image data, to compensate a color difference between a color displayed in the liquid crystal element and the display color defined by the image data caused by a change in driving conditions of the liquid crystal, so that said color displayed in the liquid crystal in response to said image data which defines the display color, cannot substantially change.

14. The method for driving a color liquid display apparatus according to claim 13, wherein the step of preparing a plurality of voltage stages includes a sub-step of preparing at least two voltage stages, preset for at least one display color, with respect to liquid crystal of the pixel corresponding to the piece of image data; and the step of applying a signal voltage corresponding to the selected voltage stage includes a sub-step of selectively applying the at least two signal voltages to the liquid crystal of the pixel.

15. The method for driving a color liquid crystal display apparatus according to claim 13, wherein the step of preparing a plurality of voltage stages, includes a sub-step of preparing at least two voltage stages, preset for at least one display color, with respect to liquid crystal of the pixel corresponding to the piece of image data; and the step of applying a signal voltage corresponding to the selected voltage stage includes a sub-step of detecting said change in conditions of driving the liquid crystal and outputting a correction signal and a sub-step of selectively applying the at least two signal voltages to the liquid crystal of the pixel in response to the correction signal, so that the same color can be displayed in response to the same image data.

16. The method for driving a color liquid display apparatus according to claim 13, wherein the step of preparing a plurality of voltage stages includes a sub-step of generating signal voltages of a number greater than a number of the plurality of display colors defined by the image data supplied from image data supplying means; and the step of applying a signal voltage corresponding to the selected voltage stage includes a sub-step of detecting a temperature of the liquid crystal display element and outputting a correction signal, a sub-step of reading a voltage stage corresponding to a signal voltage to be applied to the pixel of the liquid crystal display element, based on the image data and the correction signal, in accordance with the display color defined by the image data from storage means for storing voltage stages in each of a plurality of temperature ranges of the liquid crystal display element, and a sub-step of applying a signal voltage corresponding to the read voltage stage to liquid crystal of the pixel.

17. The method for driving a color liquid crystal display apparatus according to claim 13, wherein the step of preparing a plurality of voltage stages includes a sub-step of receiving a source voltage and generating signal voltages of a number greater than a number of the plurality of display colors defined by the image data supplied from image data supplying means; and the step of applying a signal voltage corresponding to the selected voltage stage includes a sub-step of detecting the source voltage and outputting a correction signal, a sub-step of reading a voltage signal corresponding to a signal voltage to be applied to the pixel of the liquid crystal display element, based on the image data and the correction signal, in accordance with the display color defined by the image data from storage means for storing voltage stages in each of a plurality of voltage ranges of the source voltage, and a sub-step of applying a signal voltage corresponding to the read voltage stage to liquid crystal of the pixel.

18. The method for driving a color liquid crystal display apparatus according to claim 13 wherein said liquid crystal is of a twisted nematic type containing liquid crystal molecules aligned in a twisted manner.

* * * * *